US011643842B2

(12) United States Patent
Chen

(10) Patent No.: US 11,643,842 B2
(45) Date of Patent: May 9, 2023

(54) ELECTRONIC LOCK WITHOUT ACTIVE POWER SOURCE, ELECTRONIC DEVICE HAVING THE ELECTRONIC LOCK, AND METHOD OF OPERATING THE ELECTRONIC LOCK THEREOF

(71) Applicant: Industrial Technology Research Institute, Hsinchu (TW)

(72) Inventor: Yung-Han Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 741 days.

(21) Appl. No.: 16/561,030

(22) Filed: Sep. 5, 2019

(65) Prior Publication Data

US 2020/0071957 A1 Mar. 5, 2020

Related U.S. Application Data

(60) Provisional application No. 62/727,003, filed on Sep. 5, 2018.

(51) Int. Cl.
*E05B 47/00* (2006.01)
*E05B 47/06* (2006.01)

(52) U.S. Cl.
CPC ..... *E05B 47/0001* (2013.01); *E05B 47/06* (2013.01); *E05B 2047/0048* (2013.01)

(58) Field of Classification Search
CPC ..... E05B 47/0001; E05B 47/06; E05B 2047/0048
See application file for complete search history.

(56) References Cited

U.S. PATENT DOCUMENTS 7,289,764 B2 * 10/2007 Gonzales ..... G07C 9/27 340/426.25
7,346,331 B2 * 3/2008 Taylor ..... H04W 52/0277 340/5.31

(Continued)

FOREIGN PATENT DOCUMENTS

CN 101545337 9/2009
CN 102306413 1/2012

(Continued)

OTHER PUBLICATIONS

"Office Action of Taiwan Counterpart Application", dated May 18, 2020, p. 1-p. 22.

(Continued)

*Primary Examiner* — Mark A Williams
(74) *Attorney, Agent, or Firm* — JCIPRNET

(57) ABSTRACT

The disclosure provides an electronic lock without an active power source, an electronic lock system, and a method of operating the electronic lock. According to an exemplary embodiment, the electronic lock includes a WPR which receives wireless electrical power to provide power for the electronic lock; a circuit board electrically connected to the WPR and including a wireless transceiver which receives a lock command or an unlock command; and a controller configured to generate a lock control signal or an unlock control signal in response to receiving the lock command or an unlock command; and an actuator electrically connected to the circuit board and receives the lock control signal to lock a mechanical lock component or the unlock control signal to unlock the mechanical lock component.

21 Claims, 22 Drawing Sheets

(56) References Cited

U.S. PATENT DOCUMENTS

| | | | | |
|---|---|---|---|---|
| 8,111,042 | B2 | 2/2012 | Bennett | |
| 8,180,286 | B2 | 5/2012 | Yamasuge | |
| 8,401,595 | B2 | 3/2013 | Zhu et al. | |
| 8,864,205 | B2 * | 10/2014 | Lemire | A61G 3/029 296/20 |
| 9,001,622 | B2 | 4/2015 | Perry | |
| 9,704,316 | B2 | 7/2017 | Kirkjan | |
| 10,033,436 | B2 | 7/2018 | Thubert et al. | |
| 2005/0164749 | A1 * | 7/2005 | Conforti | H04B 1/3883 455/565 |
| 2010/0031714 | A1 * | 2/2010 | Brown | E05B 47/00 70/91 |
| 2010/0307206 | A1 * | 12/2010 | Taylor | G07C 9/00309 70/91 |
| 2011/0185779 | A1 * | 8/2011 | Crass | G07C 9/00896 70/280 |
| 2012/0184338 | A1 * | 7/2012 | Kesler | H03H 7/40 455/343.1 |
| 2012/0299389 | A1 | 11/2012 | Lee et al. | |
| 2014/0113689 | A1 * | 4/2014 | Lee | H01M 10/44 455/573 |
| 2014/0302782 | A1 * | 10/2014 | Raab | H01F 38/14 455/41.1 |
| 2015/0027178 | A1 * | 1/2015 | Scalisi | E05B 47/026 292/144 |
| 2016/0065005 | A1 | 3/2016 | Won et al. | |
| 2016/0191121 | A1 | 6/2016 | Bell et al. | |
| 2017/0264134 | A1 | 9/2017 | Moshfeghi | |

FOREIGN PATENT DOCUMENTS

| | | |
|---|---|---|
| CN | 102312617 | 1/2012 |
| CN | 206140448 | 5/2017 |
| CN | 107925253 | 4/2018 |
| JP | 2016160734 | 9/2016 |
| JP | 2017172314 | 9/2017 |
| TW | 449559 | 8/2001 |
| TW | 201509055 | 3/2015 |

OTHER PUBLICATIONS

Rushi Vyas, et al., "A Battery-less, Wireless Mote for Scavenging Wireless Power at UHF (470-570 MHz) Frequencies," 2011 IEEE International Symposium on Antennas and Propagation (APSURSI), Jul. 2011, pp. 1069-1072.

Naoki Shinohara, et al., "Coexistence of Wireless Power Transfer via Microwaves and Wireless Communication for Battery-less ZigBee Sensors," 2014 International Symposium on Electromagnetic Compatibility, Tokyo, Dec. 2014, pp. 445-448.

Travis Deyle, et al., "Surface Based Wireless Power Transmission and Bidirectional Communication for Autonomous Robot Swarms," 2008 IEEE International Conference on Robotics and Automation, May 2008, pp. 1036-1041.

Fangyi Xie, et al., "Optimal Design of an Antenna Array for Energy Harvesting," IEEE Antennas and Wireless Propagation Letters, vol. 12, Jan. 2013, pp. 155-158.

Suzhi Bi, et al., Wireless Powered Communication: Opportunities and Challenges, IEEE Communications Magazine, Apr. 2015, pp. 117-125.

Shiyang Leng, et al., "Power Efficient and Secure Multiuser Communication Systems with Wireless Information and Power Transfer," 2014 IEEE International Conference on Communications Workshops (ICC), Feb. 2014, pp. 1-7.

* cited by examiner

3100

ELECTRONIC LOCK WITHOUT ACTIVE POWER SOURCE, ELECTRONIC DEVICE HAVING THE ELECTRONIC LOCK, AND METHOD OF OPERATING THE ELECTRONIC LOCK THEREOF

CROSS REFERENCE TO RELATED APPLICATION

This application claims the priority benefit of U.S. provisional application Ser. No. 62/727,003 filed on Sep. 5, 2018. The entirety of the above-mentioned patent application is hereby incorporated by reference herein and made a part of specification.

TECHNICAL FIELD

The disclosure is directed to an electronic lock without an active power source, an electronic lock system, and a method of operating the electronic lock thereof.

BACKGROUND

Conventionally, an electronic lock can be manipulated by a user when the user is in a close physical proximity. In many cases, the electronic lock would require a battery installed with designs of power saving mode in order to reduce power consumption. The electronic lock could be turned on periodically or by pushing a button on it to detect whether there is any access request. Once an access request has been detected, the electronic lock will be activated to respond to the access request and to process subsequent functions such as unlock or lock.

However, the battery of the electronic lock will gradually be drained of its power and has to be replaced or recharged, and it could be inconvenient for users who do not have a spare battery or a battery charger at hand. In some applications, as in the example of a flight luggage disposed with such electronic lock having a lithium battery, the battery could be removed by the airport security resulting in the user being unable to unlock the luggage. Therefore, it would more convenient for the user if the flight luggage which uses an electronic lock does not require any battery or any charger.

SUMMARY OF THE DISCLOSURE

Accordingly, the disclosure is directed to an electronic lock without an active power source, an electronic device for remotely controlling the electronic lock, and a method of operating the electronic lock thereof.

In one of the exemplary embodiments, the disclosure is directed to an electronic lock without an active power source, the electronic lock includes not limited to: a wireless power receiver (WPR) which receives wireless electrical power to provide power for the electronic lock; a circuit board electrically connected to the WPR and including a wireless transceiver which receives a lock command or an unlock command; and a controller configured to generate a lock control signal or an unlock control signal in response to receiving the lock command or an unlock command; and an actuator electrically connected to the circuit board and receives the lock control signal to lock a mechanical lock component or the unlock control signal to unlock the mechanical lock component.

In one of the exemplary embodiments, the disclosure is directed to an electronic lock system which includes not limited to: an electronic lock without an active power source; and an electronic device for remotely controlling the electronic lock, wherein the electronic lock including a wireless power receiver (WPR) which receives wireless electrical power to provide power for the electronic lock; a circuit board electrically connected to the WPR and including a first wireless transceiver which receives a lock command or an unlock command; and a controller configured to generate a lock control signal or an unlock control signal in response to receiving the lock command or an unlock command; and an actuator electrically connected to the circuit board and receives the lock control signal to lock a mechanical lock component or the unlock control signal to unlock the mechanical lock component.

In one of the exemplary embodiments, the disclosure is directed to a method of operating an electronic lock without an active power source, the method includes not limited to: receiving, through a WPR, wireless electrical power to provide power for the electronic lock comprising a wireless transceiver, a controller, and an actuator; receiving, through the wireless transceiver, a lock command or an unlock command; generating, by the controller, a lock control signal or an unlock control signal in response to receiving the lock command or an unlock command; and locking or unlocking, by the actuator, a mechanical lock component to lock or unlock the electronic lock in response to receiving the lock control signal or the unlock control signal.

In order to make the aforementioned features and advantages of the present disclosure comprehensible, exemplary embodiments accompanied with figures are described in detail below. It is to be understood that both the foregoing general description and the following detailed description are exemplary, and are intended to provide further explanation of the disclosure as claimed.

It should be understood, however, that this summary may not contain all of the aspect and embodiments of the present disclosure and is therefore not meant to be limiting or restrictive in any manner. Also, the disclosure would include improvements and modifications which are obvious to one skilled in the art.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
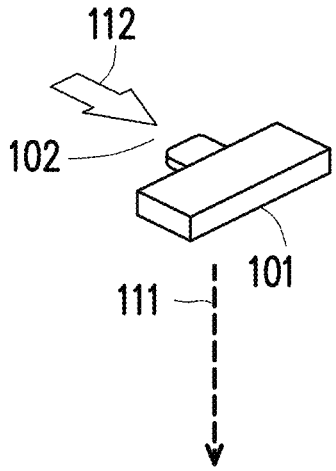
FIG. 1 illustrates a WPT according to an exemplary embodiment of the disclosure.

Reference will now be made in detail to the present exemplary embodiments of the disclosure, examples of which are illustrated in the accompanying drawings. Wherever possible, the same reference numbers are used in the drawings and the description to refer to the same or like parts.

In order to resolve the above described challenge, the disclosure proposes an electronic lock without an active power source, an electronic device having the electronic lock, and a method of using the electronic lock by utilizing means of achieving wireless power transmissions. For this disclosure, when an electronic device having a wireless electrical power transmitter, or a wireless power transmitter (WPT), is brought near an electronic lock which is without an active power source, a wireless electrical power receiver, or a wireless power receiver (WPR) of the electronic lock may supply its power to a controller of the electronic lock in order to control the electronic lock such as by locking or unlocking the electronic lock. The above described electronic device could be, for example, a mobile phone or a smart phone having a WPT and an application software (APP) to control the electronic lock. After receiving sufficient power, the WPR would subsequently provide sufficient power to the controller which may receive instructions through a communication module to perform various functions and data communications.

Thus, the disclosure provides an electronic lock without an active power source, an electronic device having the electronic lock, and a method of operating the electronic lock thereof. The disclosure provides a mechanism which activates electrical and mechanical operations of a device by wireless power transmissions. The disclosure avoids inconvenience of having to replace or recharge a battery, realizes a battery-less design for an electronic lock and associated devices, and eliminates a need for power cords.

FIG. 1 shows a wireless power transmitter (WPT) 101 which could be a device or a module to be plugged into an electronic device to transmit wireless electrical power 111 to a wireless power receiver (WPR) without using any power cables. The WPT 101 is to be plugged in to an electrical power source 112 through conductive wires or a connector 102. The WPT 101 may also allow the electronic power source 112 to control the power and the operations of the WPT 101. The WPT 101 may detect if there is an approachable WPR before transmitting any wireless power.

Figure 2:
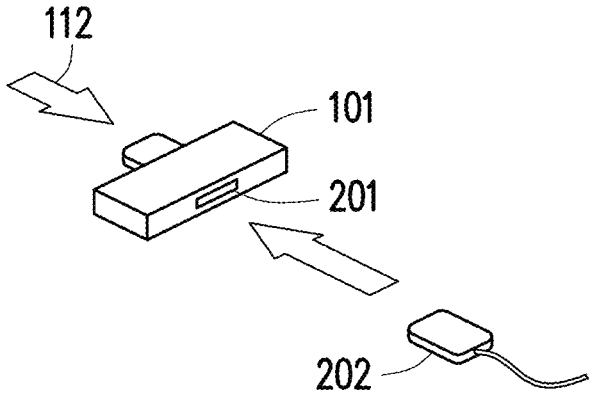
FIG. 2 illustrates a WPT having a connector for forwarding power according to an exemplary embodiment of the disclosure.

FIG. 2 shows an alternative embodiment of the wireless power transmitter (WPT) 101. The WPT 101 may further include a power outlet 201 which allows a connector 202 to be plugged into. The connector 202 would forward electrical power from the electrical power source 112 to another device.

Figure 3:
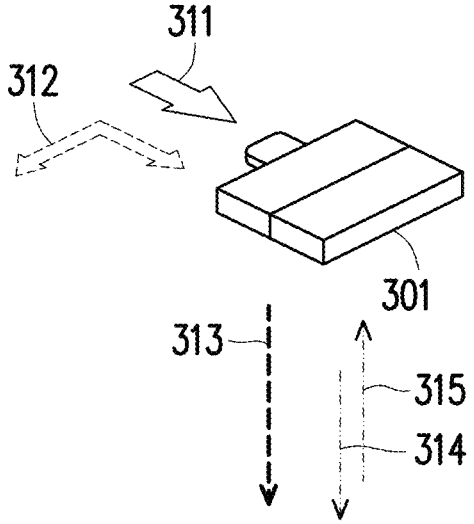
FIG. 3 illustrates a WPT which is integrated with, internally built into, or combined with a communication module according to an exemplary embodiment of the disclosure.

FIG. 3 shows a WPT 301 which is integrated with, internally built into, or combined with a communication module. The WPT 301 having the communication module may transmit a communication signal in a first direction 314 which is from a WPT 301 to a WPR and receive a communication signal in a second direction 315 which is from WPR to the WPT 301. The WPT 301 may receive power from an electrical power source 311 through conductive wires or a connector and may transmit wireless power 313 to a WPR. The communication signal may contain data 312 which can be processed by an electronic device such as a mobile phone or a smart phone. The data 312 could be modulated onto carrier waves from the wireless power 313 which is transmitted through conductive wires or a connector. It is worth noting that the above described 'first direction' consistently refers to the direction from a WPT to a WPR throughout this disclosure, and the 'second direction' consistently refers to the direction from a WPR to a WPT. The WPT 301 may also support other communication directions communication, such as a third direction and a fourth direction which will be described in other embodiments of the disclosure.

Figure 4:
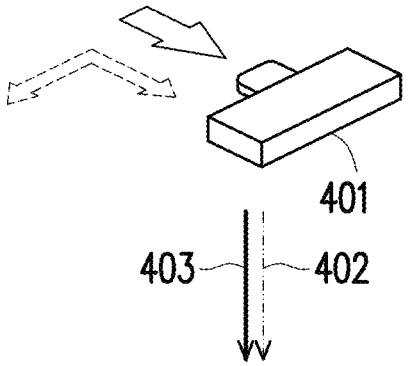
FIG. 4 illustrates a WPT of which the communication signal could be mixed or carried over a carrier wave of the wireless electrical power according to an exemplary embodiment of the disclosure.

FIG. 4 shows a WPT 401 of which the communication signal in the first direction 402 could be mixed or carried over a carrier wave of the wireless electrical power 403 if the WPT 401 contains a data processor, and a mixer.

Figure 5:
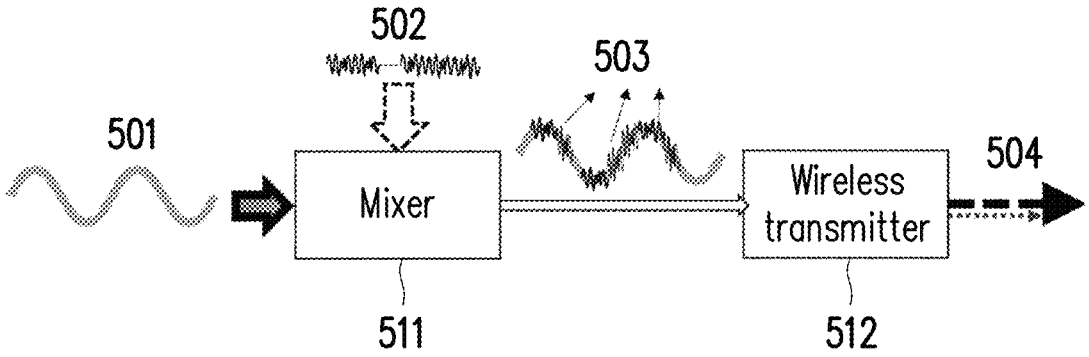
FIG. 5 illustrates an implementation having modulated data mixed into a carrier wave of an electrical power signal which is transmitted wirelessly according to an exemplary embodiment of the disclosure.

FIG. 5 shows an implementation of having modulated data mixed into a carrier wave of an electrical power signal which is transmitted wirelessly. A WPT may utilize a mixer circuit 511 electrically connected to a wireless transmitter 512. The mixer circuit 511 would receive power (for example, from electrical power source 112 as shown in FIG. 1) in the form of a carrier wave 501 which is mixed with modulated data 502 to form a modulated power signal 503 which carries data. The modulated power signal 503 could be transmitted in the first direction 504 by the wireless transmitter 512. The WPT may also be capable of modulating the unmodulated data (e.g. digital signal data) if the WPT contains a data modulator.

Figure 6:
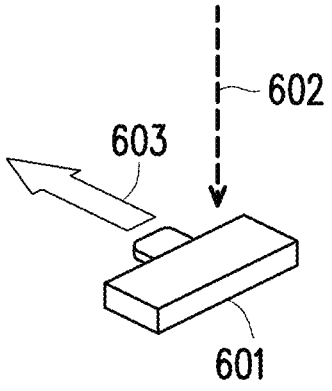
FIG. 6 illustrates a wireless power receiver that can receive wireless electrical power from a WPT without any conductive connection according to an exemplary embodiment of the disclosure.

FIG. 6 shows a wireless power receiver (WPR) 601 which is a device or a module that can receive wireless electrical power 602 from a WPT without any conductive connection. The received electrical power can be transmitted to another electrical component 603 or another device 603 through a conductive wire or a connector. The WPR 601 may also allow the connected device 603 to control its power and operation. Similar to the exemplary embodiment of FIG. 3, the WPR 601 may also integrate, internally build, or combine with a communication module.

Figure 7:
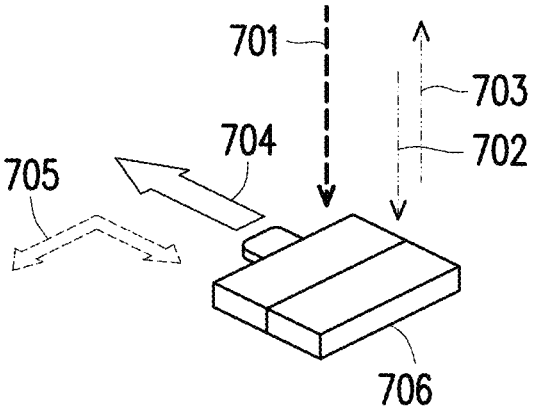
FIG. 7 illustrates a WPR which receives wireless power from a WPT and provides power to an electrical component according to an exemplary embodiment of the disclosure.

FIG. 7 shows an embodiment of a WPR 706 which receives wireless power 701 from a WPT and provides power to an electrical component 704. The WPR 706 has been combined or integrated with a communication module which is capable of receiving wireless signal in the first direction 702 and transmitting wireless signal in the second direction 703. The data 705 transmitted from or to the communication module could be processed by an electronic device which the WPR is connected with or by the communication module itself if the electronic device or the communication module contains the data processing components. The communication module may also support communication in other directions communication such as a 'third direction' and a 'fourth direction', which are described in latter parts of the disclosure.

Figure 8:
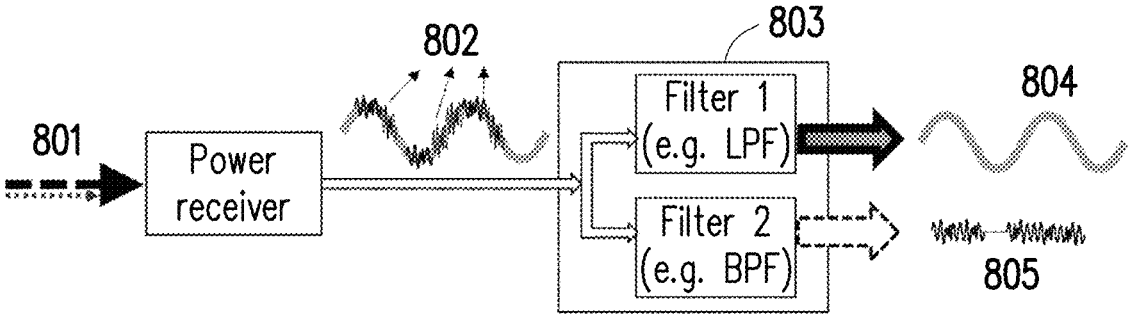
FIG. 8 illustrates a circuit for demodulating data from a wireless power carrier wave according to an exemplary embodiment of the disclosure.

FIG. 8 shows that a WPR may also receive modulated wireless electrical power 801 from which modulated data carried over a wireless power carrier wave 802 could be obtained. The WPR further contains a power-data splitter and a data processor. The data 805 carried by the wireless power carrier wave 802 could be separated from wireless electrical power 804 by using a duplexer 803 which includes a low pass filter (LPF) and a bandpass filter (BPS). The LPF is for extracting wireless electrical power 804 from the wireless power carrier wave 802 and the BPF is for extracting data 805 from the wireless power carrier wave 802.

Figure 9:
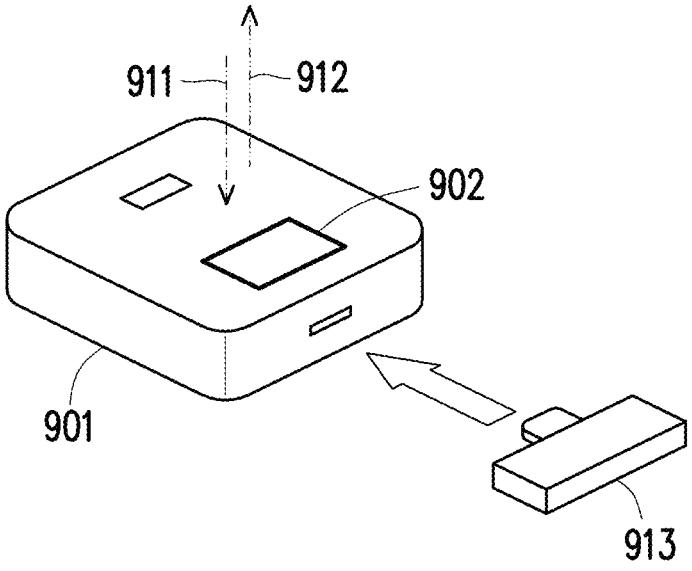
FIG. 9 illustrates an electronic lock which is to be connected to a WPR according to an exemplary embodiment of the disclosure.

The above described WPR could be integrated or connected with an electronic device to provide power for components of the electronic device. FIG. 9 illustrates an electronic lock 901 which could be a standalone device or a pluggable module and is to be connected to an external WPR 913. The electronic lock 901 could be powered solely by the WPR 913. The electronic lock 901 may include a communication module 902 which could be a wireless transceiver for receiving communication signal from an electronic device (i.e. a 'third direction' 911) and for transmitting communication signal to the electronic device (i.e. a 'fourth direction' 912). The electronic device could be, for example, a mobile phone, a tablet, or a laptop having installed an APP to interact the electronic lock 901. If a WPT also facilitate communications in the third direction and in the fourth direction, the electronic lock may also communicate with the WPT.

Figure 10:
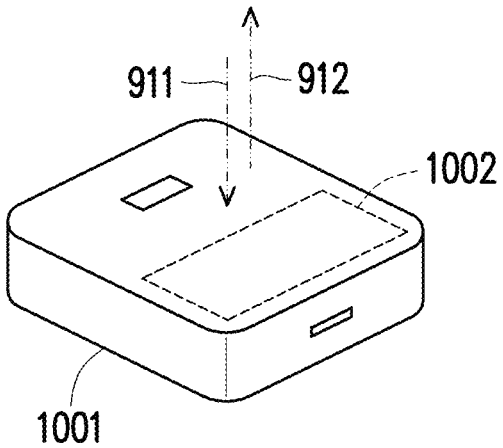
FIG. 10 illustrates an electronic lock which has been integrated with a WPR according to an exemplary embodiment of the disclosure.

FIG. 10 illustrates another embodiment of the electronic lock 1001 which is mostly similar to the electronic lock 901 of FIG. 1 except the electronic lock 1001 contains an integrated or internally built in WPR 1002.

In general, regardless whether the WPR and electronic lock are integrated or separated in different locations, The WPR and the electronic lock would likely be connected with each other via conductive wires or connectors. Upon receiving wireless electrical power, the reception of the wireless electrical power causes the WPR to trigger the functions of the electronic lock with or without an active power source such as a battery, a power supply plugged into a wall outlet. In other words, the electronic lock could be without relying on any electrical power source which has previously stored up energy supply such as a battery or a power source from the wall outlet. The electronic lock may solely rely upon the WPR for its operation. The WPR may also be the source to trigger an on or off operation of the electronic lock.

Figure 11:
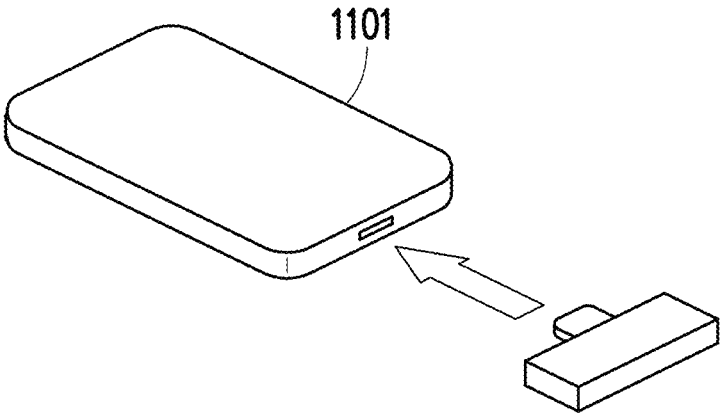
FIG. 11 illustrates an embodiment of a power source which connects to an external WPT according to an exemplary embodiment of the disclosure.
Figure 12:
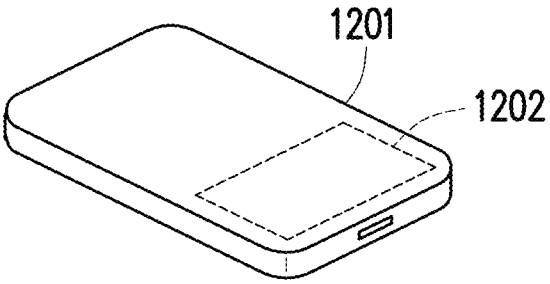
FIG. 12 illustrates an embodiment of a power source which connects to an internally integrated WPT according to an exemplary embodiment of the disclosure.

FIG. 11 illustrates an embodiment of a power source 1101 which connects to a WPT. The power source could be, for example, a power supply or a power generator, a power adapter, a battery, or a mobile electronic device such as a mobile phone, tablet, laptop, and etc. The power source 1101 may connect to a WPT via connective wireless or connectors. According to an alternative embodiment, as shown in FIG. 12, the power source 1201 may have a built-in or integrated WPT 1202.

Figure 13:
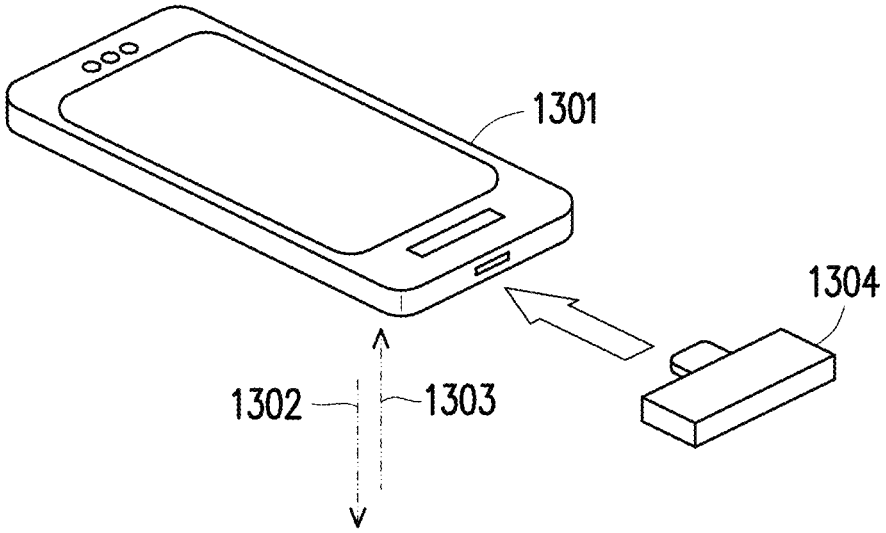
FIG. 13 illustrates an electronic device having an external WPT to serve as a controller of an electronic lock according to an exemplary embodiment of the disclosure.

FIG. 13 illustrates an embodiment of an electronic device 1301 which serves as a controller of an electronic lock. The electronic device 1301 may serve as a controller for controlling the operations of the electronic lock (e.g. 901), and the electronic device 1301 could be a mobile phone which contains a wireless transceiver for communicating with the electronic lock (e.g. 901) through an application software (APP). The device 1301 may communicate in the third direction 1302 and in the fourth direction 1303. The 'third direction' (e.g. 1302) throughout this disclosure is consistently defined as the direction from an electronic device (e.g. 1301) to an electronic lock (e.g. 901), and the 'fourth direction' throughout this disclosure is consistently defined as the direction from an electronic lock (e.g. 901) to an electronic device (e.g. 1302).

In general, the electronic device would be disposed with a WPT and the electronic lock would be disposed with a WPR, and the transceiver of the electronic device may communicate through them assuming that the WPT or WPR also contains a transceiver. For example, as shown in FIG. 13 and assuming that the electronic device is a mobile phone, the mobile phone may serve as a power source for a WPT 1304 which is externally connected to the mobile phone which may then control the power and the operation of the WPT.

Figure 14:
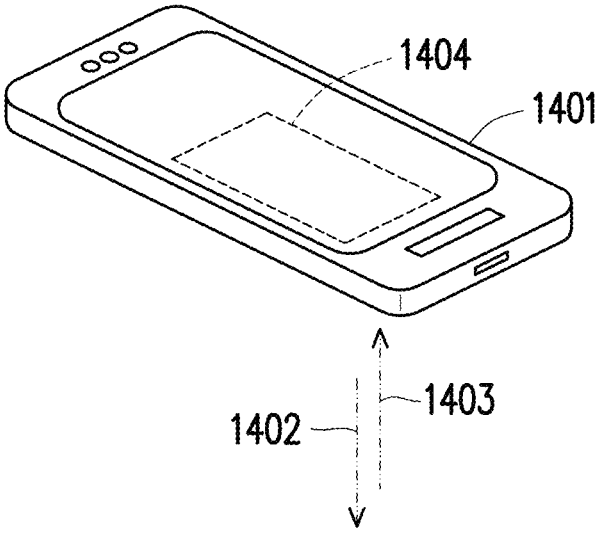
FIG. 14 illustrates an electronic device having an integrated WPT to serve as a controller of an electronic lock according to an exemplary embodiment of the disclosure.

FIG. 14 illustrates another embodiment of an electronic device 1401 which serves as a controller of an electronic lock. Similar to the embodiment of FIG. 13, the electronic device 1401 could be a mobile phone which contains a wireless transceiver for communicating in the third direction 1402 and in the fourth direction 1403. The electronic device 1404 contains an integrated WPT module which is a built-in or an embedded WPT module as shown in FIG. 14. If the WPT module 1404 contains a transceiver, the electronic device 1401 may also control the transceiver of the WPT module 1404 to transmit data to or receive data from the WPT module 1404.

Figure 15:
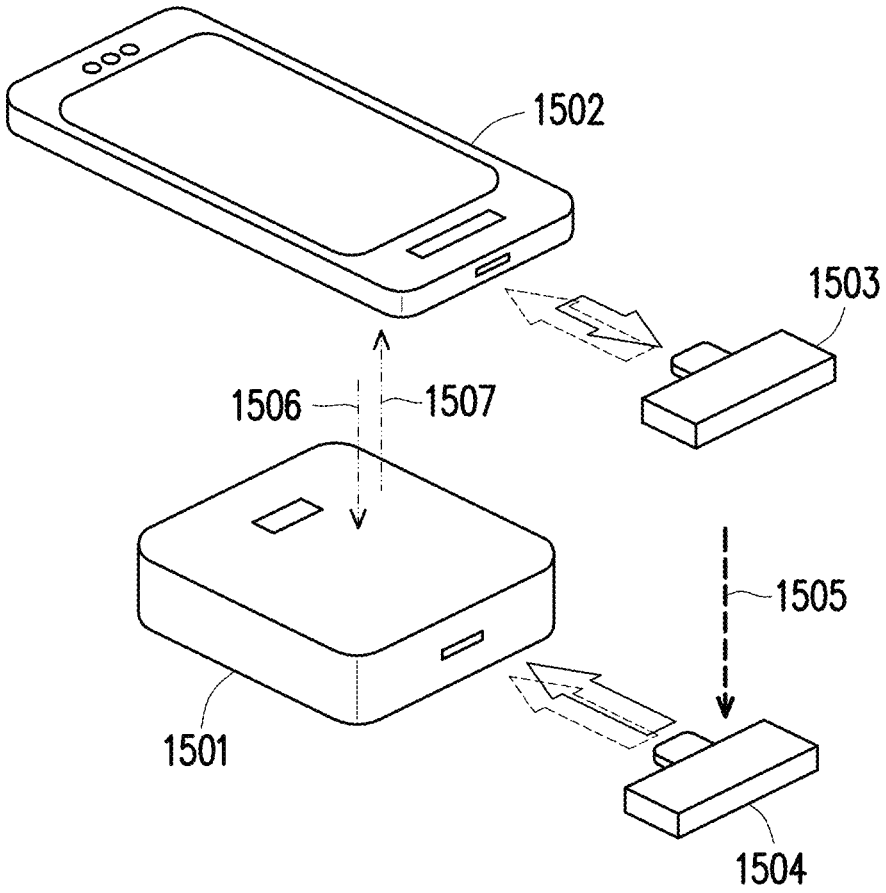
FIG. 15 illustrates interactions between an electronic device and an electronic lock according to an exemplary embodiment of the disclosure.

FIG. 15 shows an example of interactions between an electronic device 1502 and an electronic lock 1501 by using an external WPT 1503 and an external WPR 1504 respectively. In this example, the electronic device 1502 is assumed to be a mobile phone which provides power to an external WPT 1503. The external WPT 1503 would provide wireless electrical power 1505 to an external WPR 1504 which is plugged into the electronic lock 1501. After WPR 1504 receives sufficient wireless electrical power 1505, the WPR 1504 would be able to provide power needed by the electronic lock 1501 for its functions. The electronic device 1502 may also communicate modulated data onto the wireless electrical power 1505 between the WPT 1503 and the WPR 1504. Each of the electronic lock 1501 and the electronic device 1502 may include a transceiver for supporting communications in the third direction 1506 and in the fourth direction 1507.

The electronic device 1502 may interact with the electronic lock 1501 by first checking and enabling the communication functions of the electronic device 1502, and the checking and enabling of the communication functions may include checking and enabling necessary hardware and/or software in order to be able to communicate with the electronic lock 1501 assuming that the communication functions of the electronic device 1502 have not been enabled. The electronic device may enable and control the WPT 1503 through an APP or a plug-and-play function. The WPT 1503 may detect for the presence of a WPR. If the WPR 1504 has been detected by an approaching WPT 1503, the WPT 1503 may allow the wireless electrical power 1505 to be transmitted from the WPT 1503 to the WPR 1504. Alternatively, if the WPT 1503 is controlled by electronic device 1502, then when the WPT 1503 approaches and detects the WPR 1504, the WPT 1503 would send signals about the detected WPR 1504 to the electronic device 1502. Then, the electronic device 1502 may direct its electrical power to the WPT 1503 device for wireless transmission. On the other hand, the electronic lock 1501 is configured to be turned-on when the WPR 1504 receives wireless electrical power within a specific range of wattage and may use the wireless electrical power from the WPR 1504 alone or in conjunction with another power source such as an internal battery as its operating power. After the electronic lock 1501 is turned-on, the electronic device may enable its communication function, including hardware and/or software, and then engage in communications with electronic device 1502.

Figure 16:
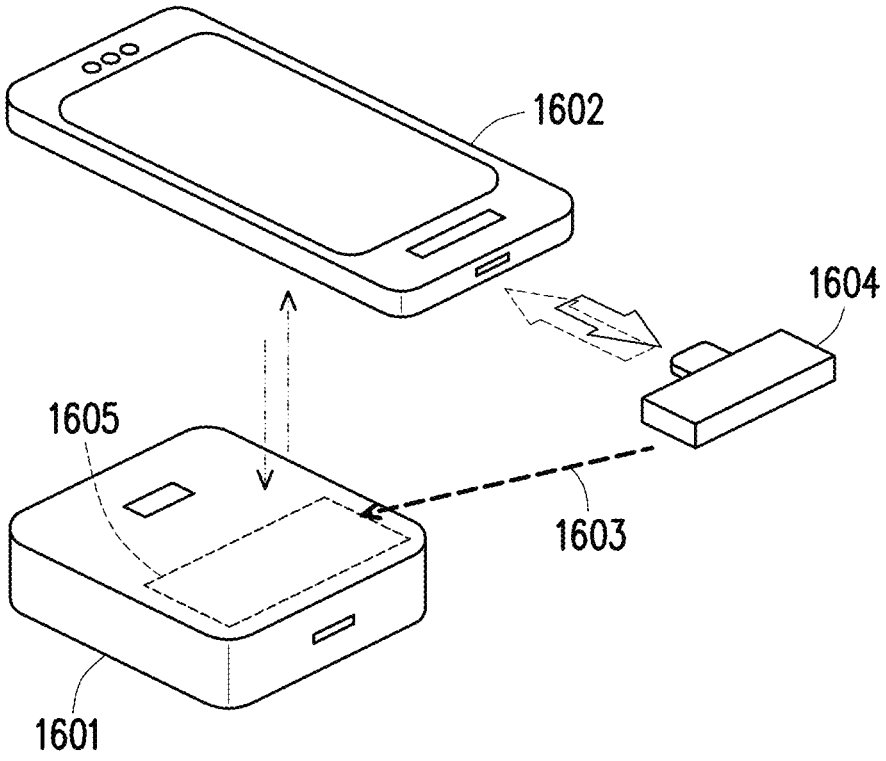
FIG. 16 illustrates interactions between an electronic device and an electronic lock having a built in WPR module according to an exemplary embodiment of the disclosure.

FIG. 16 shows an example of interactions between an electronic device 1602 and an electronic lock 1601 by using an external WPT 1604 and an internally integrated WPR respectively. In this example, the electronic device 1602 is assumed to be a mobile phone which provides power to an external WPT 1604. The external WPT 1604 would provide wireless electrical power 1603 to an internally integrated WPR module 1605 which is plugged into the electronic lock 1601. After WPR module 1605 receives sufficient wireless electrical power 1603, the WPR module 1605 would be able to provide power needed by the electronic lock 1601 for its functions. The rest of the operations are similar to the example of FIG. 15.

Figure 17:
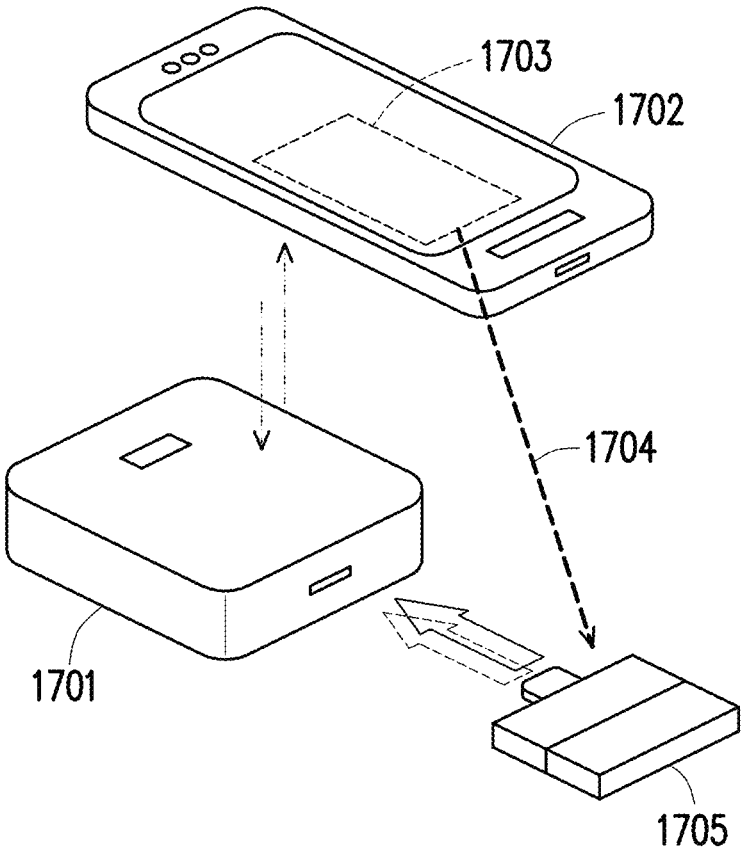
FIG. 17 illustrates interactions between an electronic device and an electronic lock by using an internally integrated WPT and an external WPR respectively according to an exemplary embodiment of the disclosure.

FIG. 17 shows an example of interactions between an electronic device 1702 and an electronic lock 1701 by using an internally integrated WPT and an external WPR 1705 respectively. In this example, the electronic device 1702 is assumed to be a mobile phone which provides power to an internally integrated WPT module 1703. The WPT module 1703 would provide wireless electrical power 1704 to an external WPR 1705 which is plugged into the electronic lock 1701. After the WPR 1705 receives sufficient wireless electrical power 1704, the WPR 1705 would be able to provide power needed by the electronic lock 1701 for its functions. The rest of the operations are similar to the example of FIG. 15.

Figure 18:
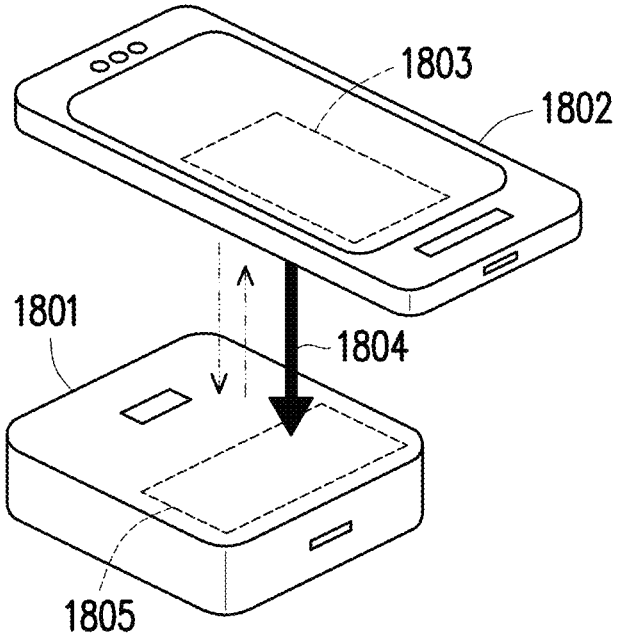
FIG. 18 illustrates interactions between an electronic device and an electronic lock by using an internally integrated WPT and an internally integrated WPR respectively according to an exemplary embodiment of the disclosure.

FIG. 18 shows an example of interactions between an electronic device 1802 and an electronic lock 1801 by using an internally integrated WPT and an internally integrated WPR respectively. In this example, the electronic device 1802 is assumed to be a mobile phone which provides power to an internally integrated WPT module 1803. The WPT module 1803 would provide wireless electrical power 1804 to an internally integrated WPR 1805 which is plugged into the electronic lock 1801. After the WPR 1805 receives sufficient wireless electrical power 1804, the WPR 1805 would be able to provide power needed by the electronic lock 1801 for its functions. The rest of the operations are similar to the example of FIG. 15.

Figure 19:
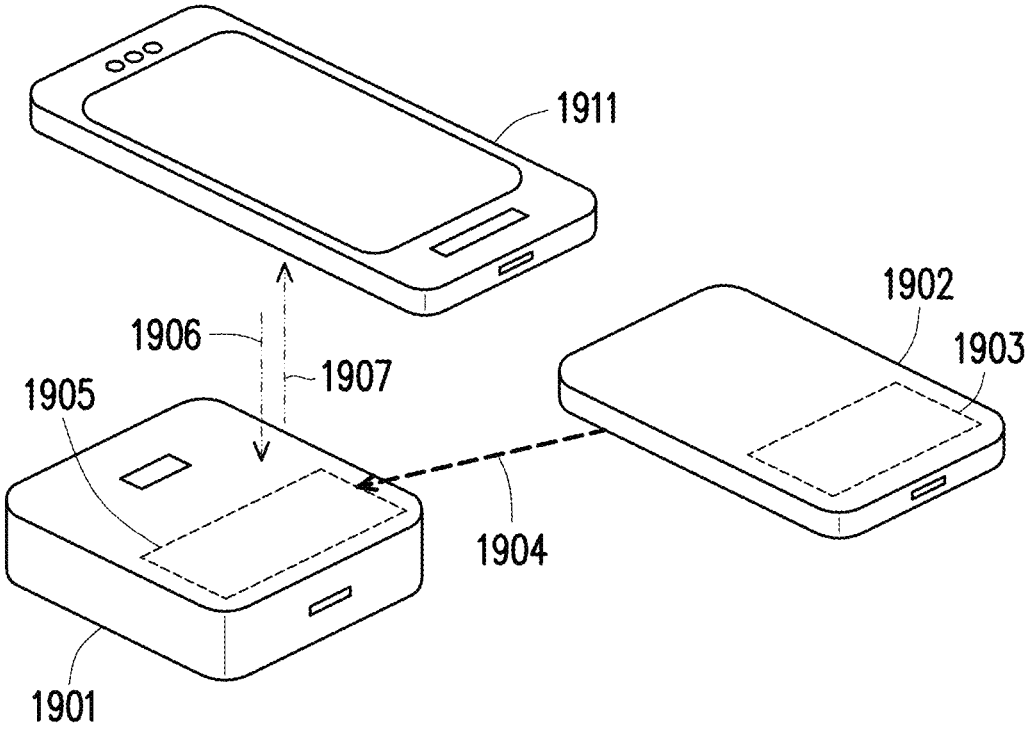
FIG. 19 illustrates interactions among an electronic device, a power source which includes an internally integrated WPT module, and an electronic lock which includes an internally integrated WPT module according to an exemplary embodiment of the disclosure.

FIG. 19 shows an example of interactions among an electronic device, a power source which includes an internally integrated WPT module, and an electronic lock which includes an internally integrated WPT module. As shown in FIG. 19, the power source 1902 includes the internally integrated WPT module 1903 which provides wireless electrical power 1904 to the WPR module 1905. The WPR module 1905 is internally integrated within and provides power to the electronic lock 1901. The electronic device 1911 which could be a mobile phone may use its transceiver to control the electronic lock 1901 such as by locking or unlocking the electronic lock 1901 through an APP. Thus, a user of the electronic device 1911 may use the installed APP to use the transceiver to control the electronic lock 1901 by transmitting and receiving communication signals through the third direction 1906 and the fourth direction 1907.

Also, in this example, the electronic device 1911 may check and enables its communication function which includes the hardware and/or software, to be able to communicate with the electronic lock 1901 assuming that the communication function has not been enabled. The functions of WPT module 1903 in the power source 1902 may be enabled through a button or a switch on the power source 1902. Once the WPT module 1903 has been enabled, the WPT module 1903 would detect the WPR module 1905. If the WPR module 1905 has been detected by the WPT module 1903 as one approaches the other, the WPT module 1903 would direct the electrical power from the power source 1902 to transmit wireless electrical power 1904 to the WPR module 1905. On the other hand, the electronic lock 1901 is configured to be turned-on when the WPR module 1905 receives sufficient electrical power or electrical power within a specific range so as to power the functions of the electronic lock 1901. After the electronic lock 1901 has been turned-on, the electronic lock 1901 may enable its communication function including hardware and/or software and communicate with the electronic device 1911. Alternatively, the electronic lock 1901 may also be the electronic lock 901 with an external WPR in FIG. 9, and the power source 1902 may also be the power source 1101 with an external WPT in FIG. 11.

Figure 20:
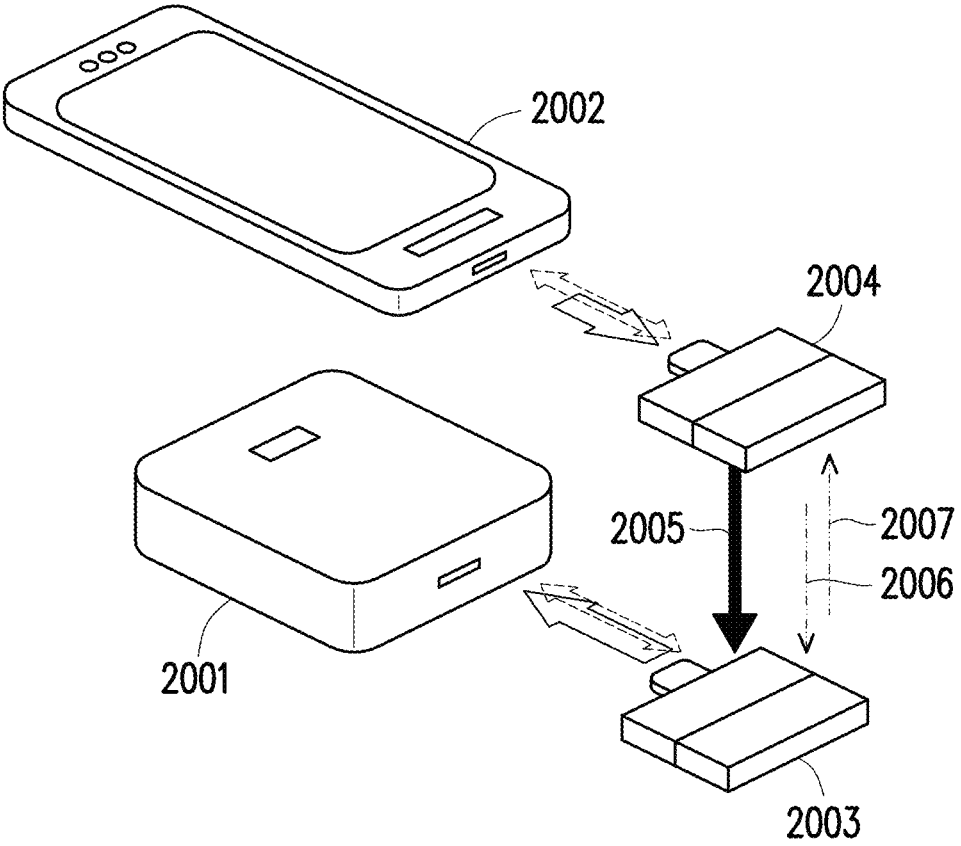
FIG. 20 illustrates interactions between an electronic lock having an external WPR integrated or combined with a communication module and an electronic device having an external WPT that is integrated or combined with a communication module according to an exemplary embodiment of the disclosure.

FIG. 20 shows interactions between an electronic lock 2001 having an external WPR integrated or combined with a communication module and an electronic device 2002 such as a mobile phone having an external WPT that is integrated or combined with a communication module. Similarly, the electronic lock 2001 is also connected to an external WPR device which is also integrated or combined with a communication module. The WPT 2004 could be controlled through an APP installed in the electronic device 2002 or a plug-and-play driver to implement the functions of the WPT 2004. The WPT 2004 may attempt to detect a WPR 2003. If the WPT 2004 and the WPR 2003 approach each other, the WPR 2003 could be detected by the WPT 2004. The electrical power would be allowed either by the electronic device 2002 or by the WPT 2004 to be directed from the electronic device 2002 to the WPT 2004 for transmitting to the WPR 2003 in the form of wireless electrical power 2005.

Alternatively, if the WPT 2004 is controlled by the electronic device 2002 and when the WPT 2004 detects the approving WPR 2003, the WPT 2004 may send a signal which indicates that the WPR has been detected to the electronic device 2002. Next, the electronic device 2002 may direct its electrical power and data links to the WPT device 2004 which has been integrated or combined with a communication module for wireless power transmission and communications. On the other hand, the electronic lock 2001 is configured to be turned-on when the WPR 2003 has received sufficient electrical power which is within a specific range to enable the WPR 2003 to solely, or in conjunction with an internal battery of the electronic lock 2001, provide electrical power to support the operation of the electronic lock 2001. After the operation of the electronic lock 2001 has been turned-on, the electronic lock 2001 would enable the data links with the communication module of the WPR 2003 so that the end-to-end data link between the electronic device 2002 and the electronic lock 2001 could be established.

If the communication module of the WPT 2004 is capable for communication in the third direction or in the fourth direction, the WPT 2004 may communicate with the electronic lock 2001 directly. If the communication module of the WPR 2003 communication module is capable for communications in the third direction and in the fourth direction, the WPR 2003 may communicate with the electronic device 2003 directly. Assuming that the WPT 2004 and the WPR 2003 can communication with each other in the first direction 2006 and the second direction 2007, the communication in the first direction 2006 could be mixed or carried over the wireless electrical power 2005 between the WPT 2004 and the WPR 2003.

Figure 21:
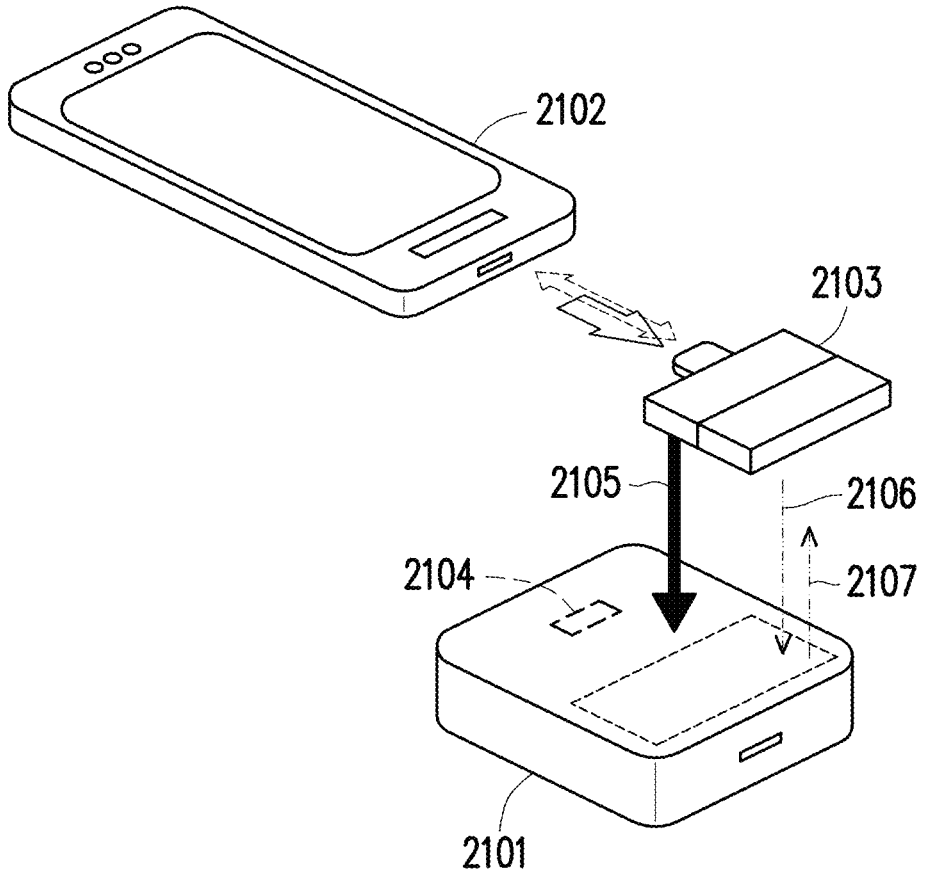
FIG. 21 illustrates interactions between an electronic lock having an external WPR integrated or combined with a communication module and an electronic device having an internal WPT that is integrated or combined with a communication module according to an exemplary embodiment of the disclosure.

FIG. 21 shows interactions between an electronic lock 2101 and an electronic device 2102. The electronic lock 2101 has an internally integrated WPR 2104 which includes a communication module, and the electronic device 2102 could be a mobile phone having an external WPT 2103 which also includes a communication module. The WPT 2103 transmit wireless electrical power 2105 to the WPR 2104 when the WPT 2103 has detected the presence of the WPR 2014 as the WPT 2103 approaches the WPR 2014 or vice versa. The communication module of the WPT 2103 and the communication module of the WPR 2014 would support wireless communications between the WPT 2103 and the WPR 2014 in the first direction 2106 and in the second direction 2107. The principle of operation of FIG. 21 is similar to the principle of operation of FIG. 20.

Figure 22:
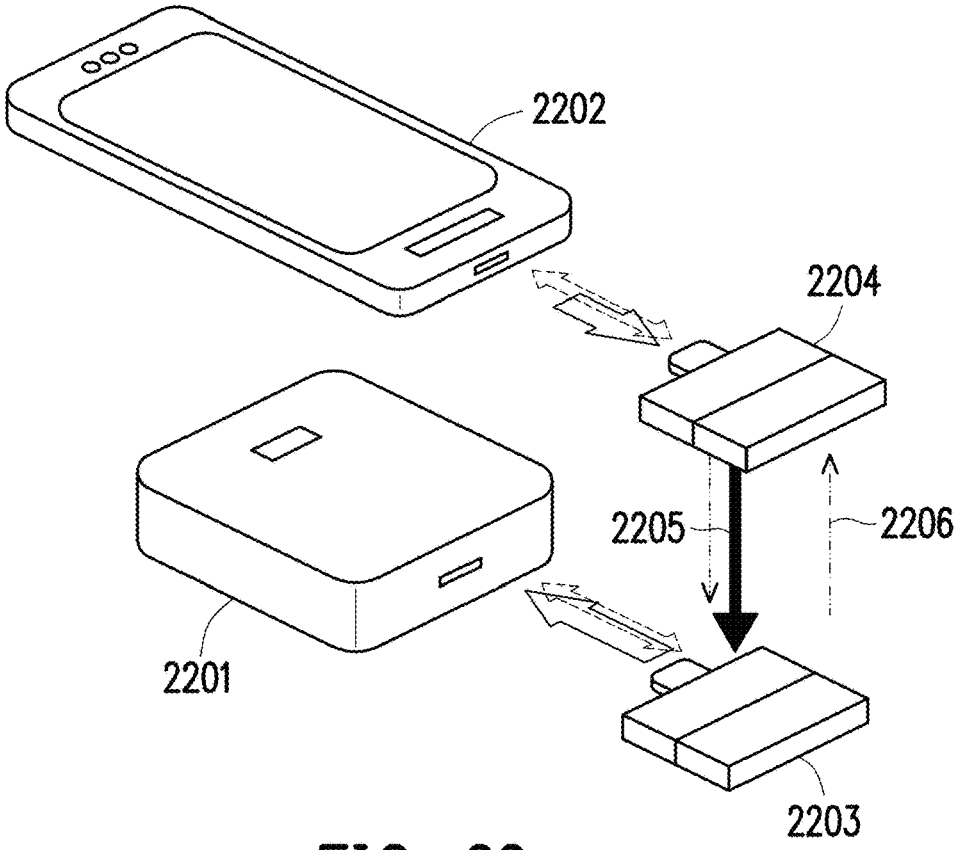
FIG. 22 illustrates an alternative exemplary embodiment of FIG. 20.

FIG. 22 shows a different example of interactions between an electronic lock 2201 having an external WPR 2203 integrated or combined with a communication module and an electronic device 2202 such as a mobile phone having an external WPT 2204 that is integrated or combined with a communication module. In this example, the wireless electrical power 2205 may carry modulated data transmitted in the first direction whereas the communication modules of the WPT 2204 and the WPR 2203 are used to implement data transmission in the second direction 2206. In this way, the mobile phone may control the electronic lock by sending data in the first direction over the wireless electrical power 2205 and receiving data in the second direction 2206 through the communication modules of the WPR and WPT.

Figure 23:
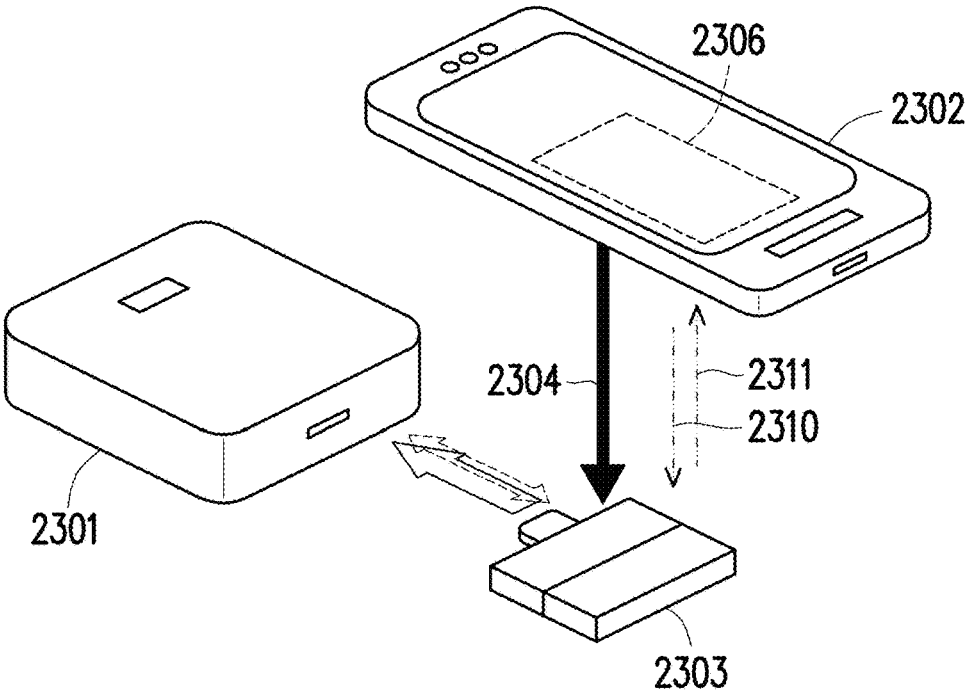
FIG. 23 illustrates interactions between an electronic lock having an external WPR that is integrated or combined with a communication module and an electronic device such as a mobile phone having an internally integrated WPT that is integrated or combined with a communication module according to an exemplary embodiment of the disclosure.

FIG. 23 shows interactions between an electronic lock 2301 having an external WPR 2303 that is integrated or combined with a communication module and an electronic device 2302 such as a mobile phone having an internally integrated WPT 2306 that is integrated or combined with a communication module. The WPT 2306 could be controlled through an APP installed within the electronic device 2302 or a plug-and-play driver to enable the functions of the WPT 2306. The WPT 2306 may detect the WPR 2302 as one approaches the other. If the WPR 2303 is detected by the WPT 2306, the electronic device 2306 may allow the electrical power directed from the WPT 2303 to transmit wirelessly to the WPR 2302. Alternatively, if the WPT 2306 is controlled by the electronic device 2302, and when the WPT 2306 detects the WPR 2303, the WPT 2306 may send a signal to indicate that the WPR 2303 has been detected to the electronic device 2302 which would then direct its electrical power and data links to the WPT module 2306 for wireless power transmission and communications. On the other hand, the electronic lock 2301 is configured to be turned on when the external WPR 2303 has received sufficient electrical power which is within a specific range and may use the electrical power from WPR 2303 or another power source such as the internal battery as its operation power. After the electronic lock 2301 has been turned on, the electronic may enable the data links with the communication module of the WPR 2303 so that the end-to-end data link between the electronic lock 2301 and the electronic device 2302 can be established. If the communication module of the WPT 2306 is capable for communications in the third direction 2310 and in the fourth direction 2311, then the WPT 2306 would be able to communicate with the electronic lock 2301 directly. If communication module of the WPR 2303 is capable for communications in the third direction 2310 and in the fourth direction 2311, then the WPR 2303 would be able to communicate with the electronic device 2302 directly. Alternatively, communications in the first direction could be mixed or carried over the wireless electrical power 2304 from the WPT 2306 to the WPR 2303. If only the communication in first direction communication is required (one-way communication), then the communication in the second direction may not be implemented.

Figure 24:
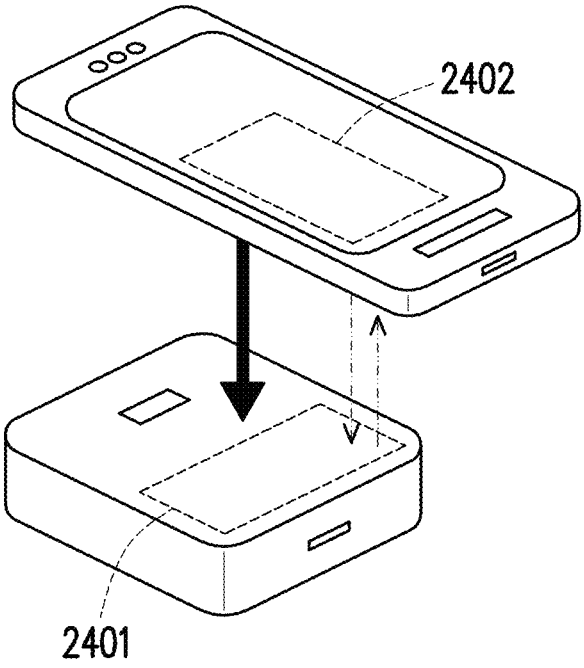
FIG. 24 illustrates interactions between an electronic lock having an internally integrated WPR that is integrated or combined with a communication module and an electronic device such as a mobile phone having an internally integrated WPT that is integrated or combined with a communication module according to an exemplary embodiment of the disclosure.

FIG. 24 shows interactions between an electronic lock having an internally integrated WPR that is integrated or combined with a communication module and an electronic device such as a mobile phone having an internally integrated WPT that is integrated or combined with a communication module. This exemplary embodiment is similar to the exemplary embodiment of FIG. 18, but the internally integrated WPT module 2402 also includes a communication module, and the internally integrated WPR module 2401 also includes a communication module. The communication modules of the WPT module 2402 and the WPR module 2401 may facilitate communications in the first direction and in the second direction, and the wireless electrical power is transmitted from the WPT module 2402 to the WPR module 2401.

Figure 25:
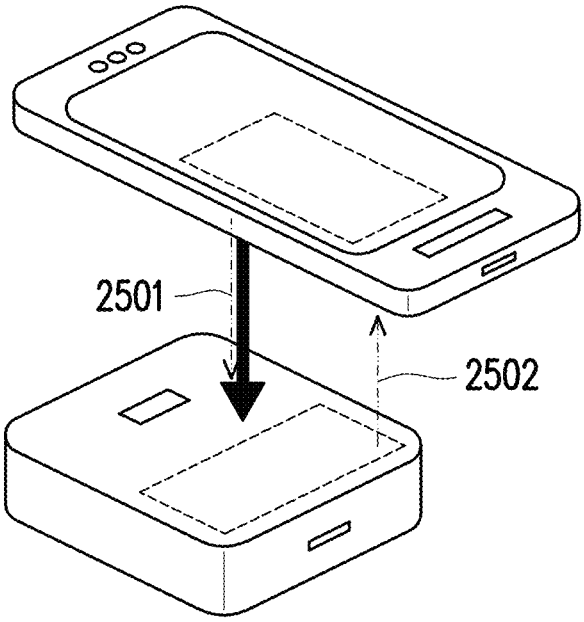
FIG. 25 illustrates interactions between an electronic lock having an internally integrated WPR that is integrated or combined with a communication module and an electronic device such as a mobile phone having an internally integrated WPT that is integrated or combined with a communication module according to an exemplary embodiment of the disclosure.

FIG. 25 shows another example of interactions between an electronic lock having an internally integrated WPR that is integrated or combined with a communication module and an electronic device such as a mobile phone having an internally integrated WPT that is integrated or combined with a communication module. In this example, the principle operation is similar to FIG. 24, but the communication in the first direction 2501 is implemented by having the modulated data carried by the wireless electrical power transmitted from the WPT to the WPR, and the communication in the second direction 2502 is implemented by having the communication module of the WPR transmitting to the communication module of the WPT.

Figure 26:
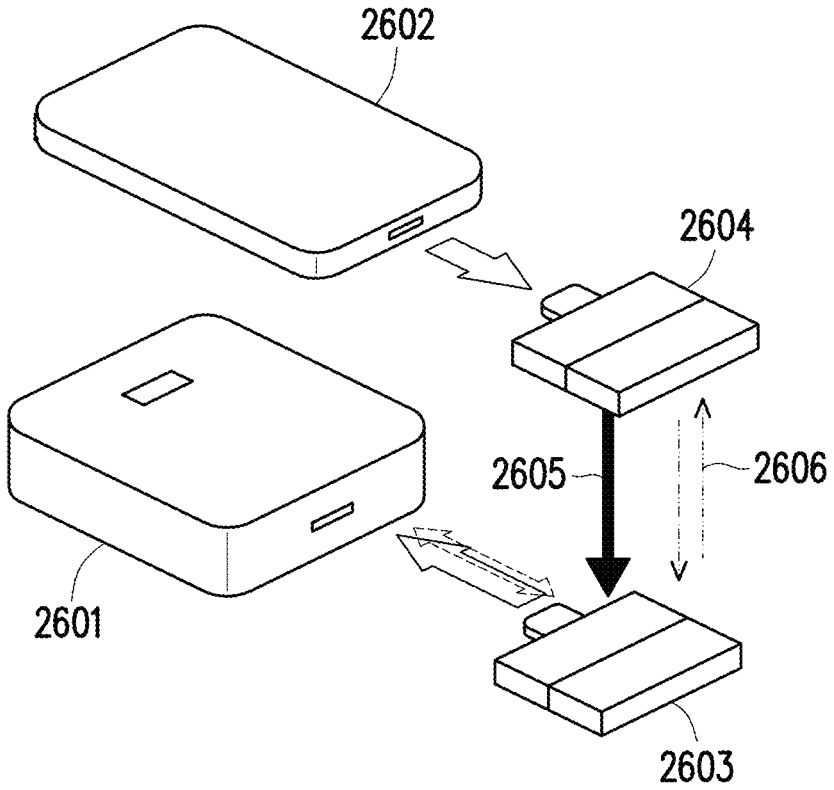
FIG. 26 illustrates interactions between an electronic lock having an external WPR integrated or combined with a communication module and a power source having an external WPT that is integrated or combined with a communication module according to an exemplary embodiment of the disclosure.

FIG. 26 shows interactions between an electronic lock having an external WPR integrated or combined with a communication module and a power source having an external WPT that is integrated or combined with a communication module. As shown in FIG. 26, both the WPT 2604 and the WPR 2603 contain their own communication modules and data processors, so that the WPT 2604 and the WPR 2603 may establish data communication links with other devices without any controller device. Once the power source 2602 is connected and the electrical power is available, the WPT 2604 could be enabled by a plug-and-play driver. After the WPT 2604 has detected the WPR 2603 when one approaches the other, the WPT 2604 may allow the electrical power to be directed from the power source 2602 to transmit wirelessly to the WPR 2603 and establish communications in the first direction and the second direction. On the other hand, the electronic lock 2601 is configured to be turned on when an external WPR device 2603 (or a built-in WPR module) receives sufficient electrical power which is within a specific range and may use the electrical power from WPR 2603 solely or in conjunction with another power source such as an internal battery as its operation power. After the data communication links between the electronic lock and communication module of the WPR 2603 is established, the end-to-end data link between the data processor of the WPT 2604 and the data processor of the electronic lock device 2601 could be established. Alternatively, data communication in the first direction 2605 can be mixed/carried over the wireless power signal from the WPT 2604 to the WPR 2603. In additions, if only the communication in the first direction 2605 is required (one-way communication), then the communication in the second direction 2606 may not be implemented.

Figure 27:
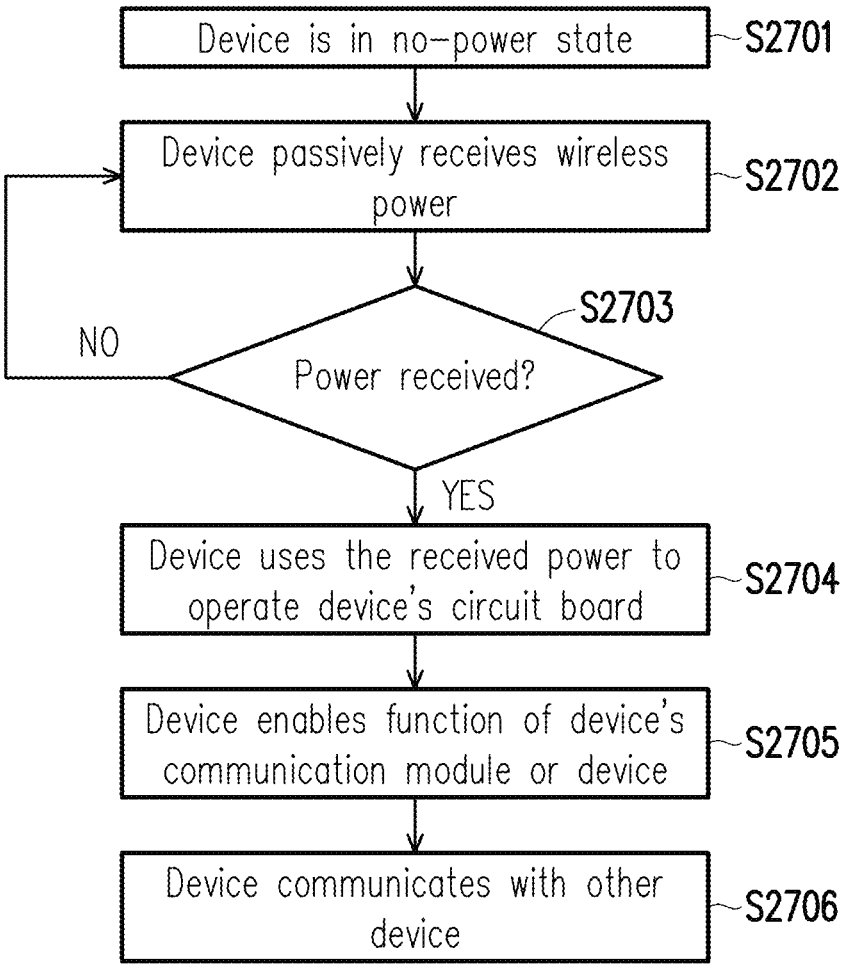
FIG. 27 illustrates a method of operating an electronic lock according to an exemplary embodiment of the disclosure.

FIG. 27 illustrates a method of operating an electronic lock according to an exemplary embodiment of the disclosure. In step S2701, the electronic lock is assumed to be in a no-power state under which the electronic lock has not been powered up by an active power source and does not possess any active power source including a battery, a power supply, a power cord, and etc. In step S2702, the electronic lock passively receives wireless electrical power. In step S2703, the electronic lock determines whether sufficient wireless electrical power has been received in order to operate the functions of the electronic lock. If not, then step S2702 is repeated. If yes, step S2704 is performed. In step S2704, the electronic lock uses the received wireless electrical power to operate circuit board. In step S2705, the electronic lock enables functions of a transceiver of the circuit board of the electronic lock after the circuit board has been activated. In step S2706, the transceiver of the electronic lock would communicate with another electronic device or with an external module.

Figure 28:
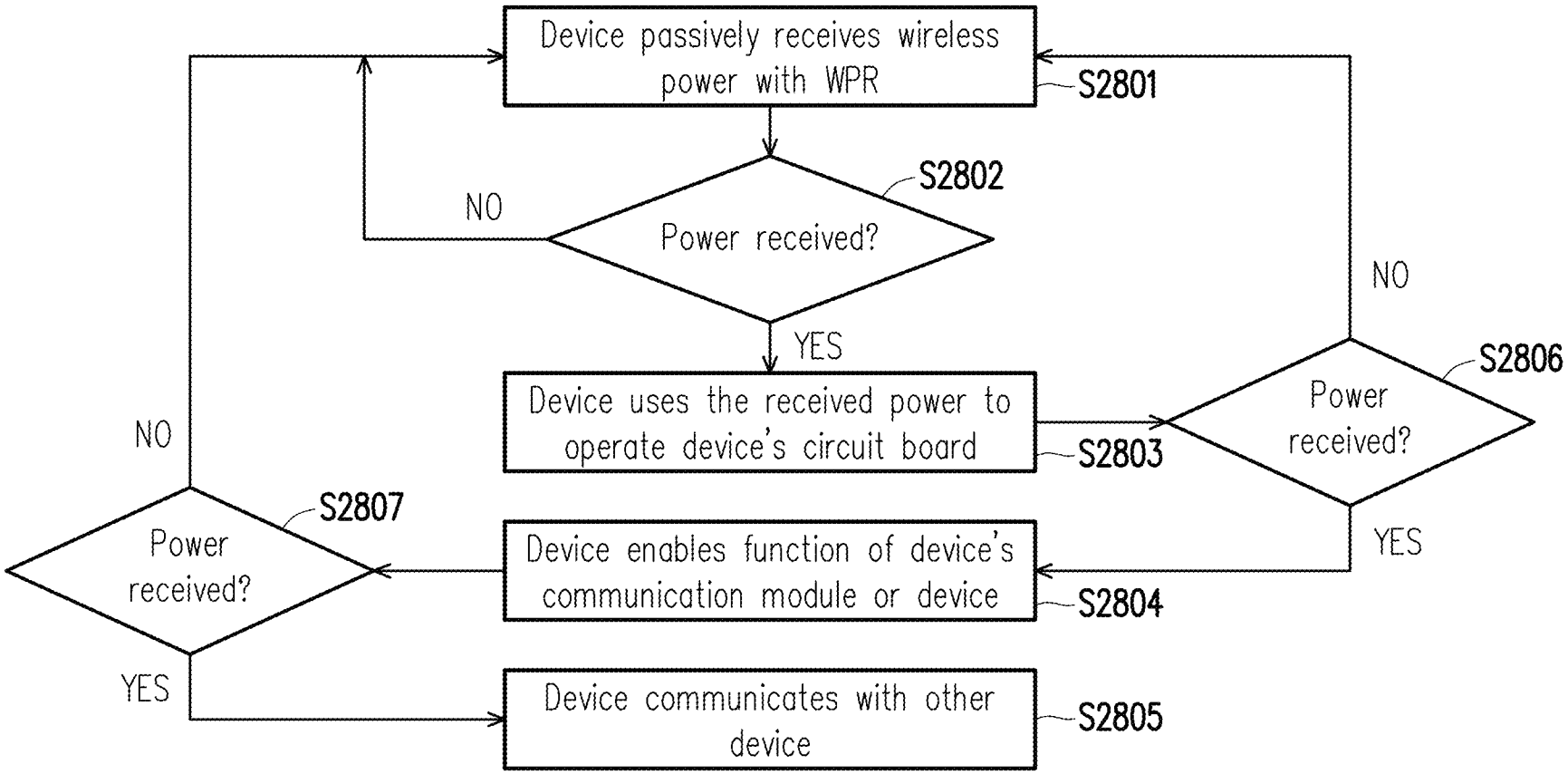
FIG. 28 illustrates a method of operating an electronic lock without assuming power continuity according to another exemplary embodiment of the disclosure.

FIG. 28 illustrates a method of operating an electronic lock, but power continuity of the electronic lock is not assumed for this embodiment. In step S2801, the electronic lock passively receives wireless electrical power via a WPR. In step S2802, the electronic lock determines whether sufficient wireless electrical power has been received in order to operate the functions of the electronic lock. If not, then step S2801 is repeated. If yes, step S2803 is performed. In step S2803, the electronic lock uses the received wireless electrical power to operate circuit board. Moreover, in step S2806, the electronic lock determines whether sufficient wireless electrical power has been received in order to operate the functions of the electronic lock. If not, then step S2801 is repeated. If yes, step S2804 is performed. In step S2804, the electronic lock enables functions of a transceiver of the circuit board of the electronic lock after the circuit board has been activated. In step S2807, the electronic lock determines whether sufficient wireless electrical power has been received in order to operate the functions of the electronic lock. If not, then step S2801 is repeated. If yes, step S2805 is performed. In step S2805, the transceiver of the electronic lock would communicate with another electronic device or with an external module.

Figure 29:
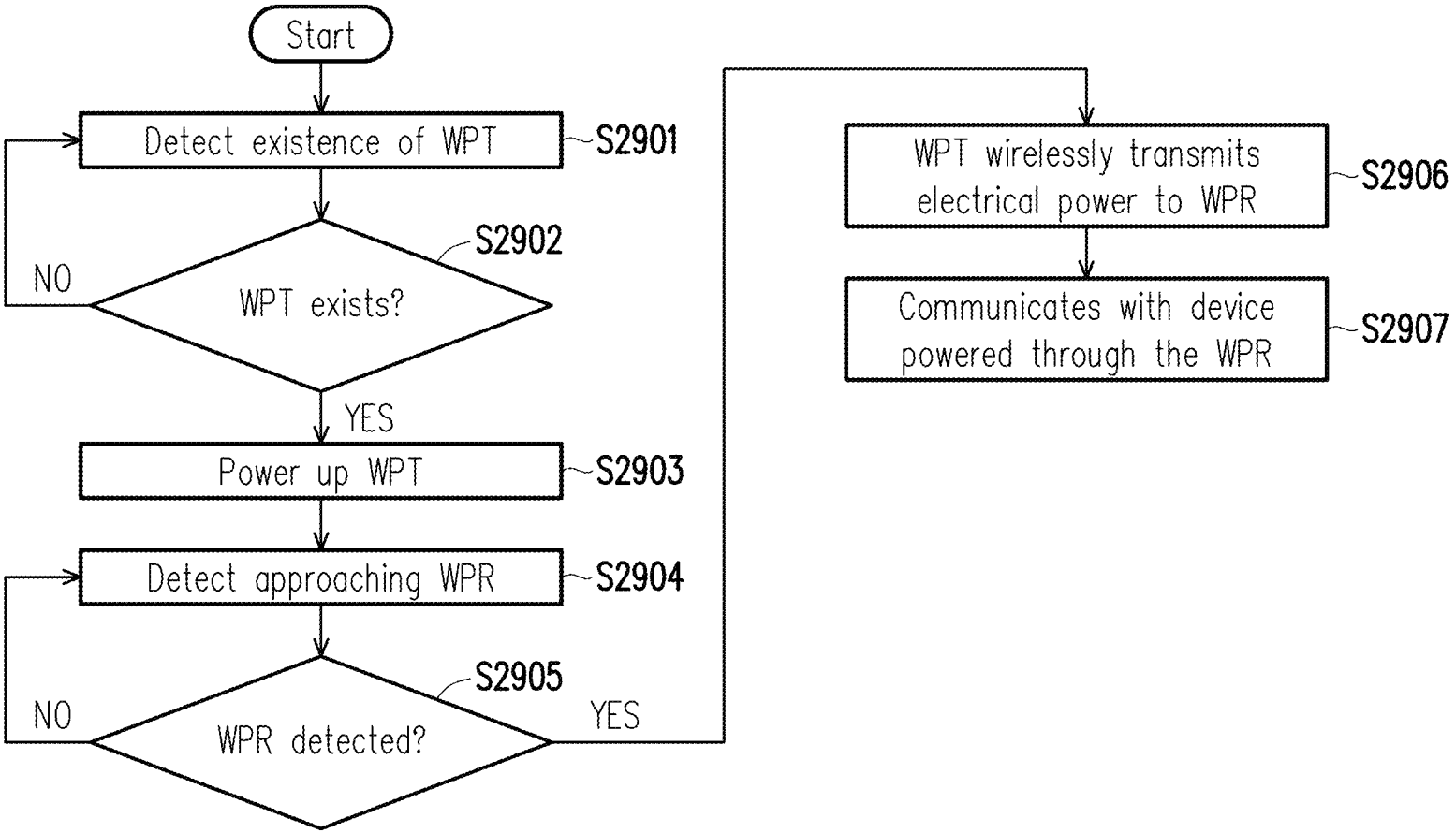
FIG. 29 illustrates a method of operating an electronic lock from the perspective of an electronic device which controls the electronic lock according to an exemplary embodiment of the disclosure.

FIG. 29 illustrates a method of operating an electronic lock from the perspective of an electronic device which controls the electronic lock according to an exemplary embodiment of the disclosure. The electronic device could be any mobile electronic device described previously and serves as a controller for the electronic lock. In step S2901, the electronic device would detect the presence of a WPT which could be externally connected or internally integrated. In step S2902, if the WPT has been detected, step S2903 would proceed. If the WPT has not been detected, then step S2901 would repeat. In step S2903, the electronic device would power up the WPT. In step S2904, the electronic device would detect whether WPR is detected when the WPT and the WPR approaches one another or each other. In step S2905, if the WPR has been detected, step S2906 would proceed. If the WPR has not been detected, then step S2904 would repeat. In step S2906, the WPR would wirelessly transmit electrical power to the detected WPR. In step S2907, the electronic device would communicate with the electronic lock which is powered through the WPR.

Figure 30:
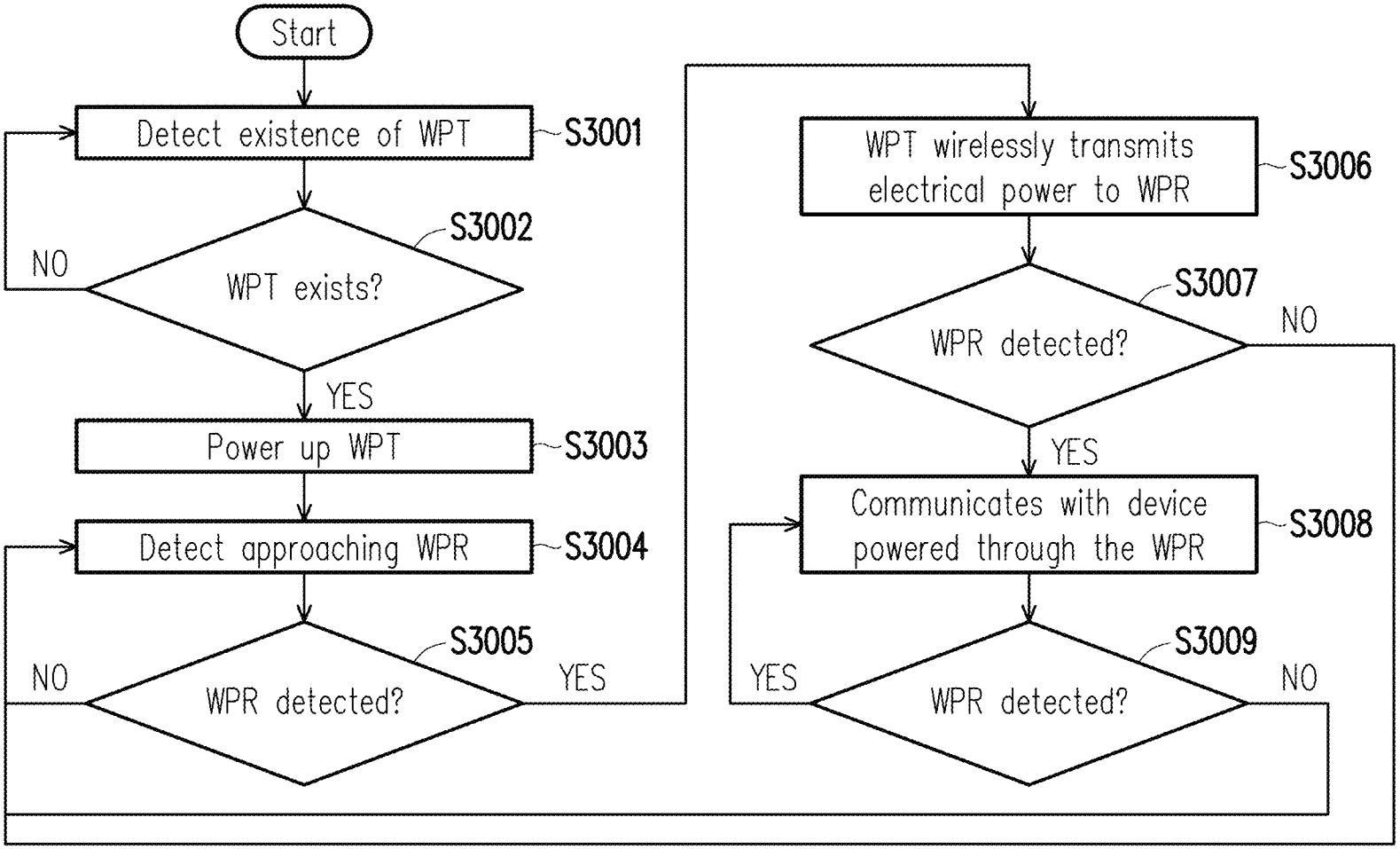
FIG. 30 illustrates a method of operating an electronic lock from the perspective of an electronic device which controls the electronic lock without assuming power continuity according to another exemplary embodiment of the disclosure.

FIG. 30 illustrates a method of operating an electronic lock from the perspective of an electronic device which controls the electronic lock, but the power continuity is not assumed. In step S3001, the electronic device would detect the presence of a WPT which could be externally connected or internally integrated. In step S3002, if the WPT has been detected, step S3003 would proceed. If the WPT has not been detected, then step S3001 would repeat. In step S3003, the electronic device would power up the WPT. In step S3004, the electronic device would detect whether WPR is detected when the WPT and the WPR approaches each other. In step S3005, if the WPR has been detected, step S3006 would proceed. If the WPR has not been detected, then step S3004 would repeat. In step S3006, the WPR would wirelessly transmit electrical power to the detected WPR. In step S3007, the electronic device would detect whether WPR is still detected. If the WPR is still detected, step S3008 would proceed. If the WPR is no longer detected, step S3004 would repeat. In step S3008, the electronic device would communicate with the electronic lock which is powered through the WPR. In step S3009, the electronic device would detect whether WPR is still detected. If the WPR is still detected, step S3008 would repeat. If the WPR is no longer detected, step S3004 would repeat.

Figure 31:
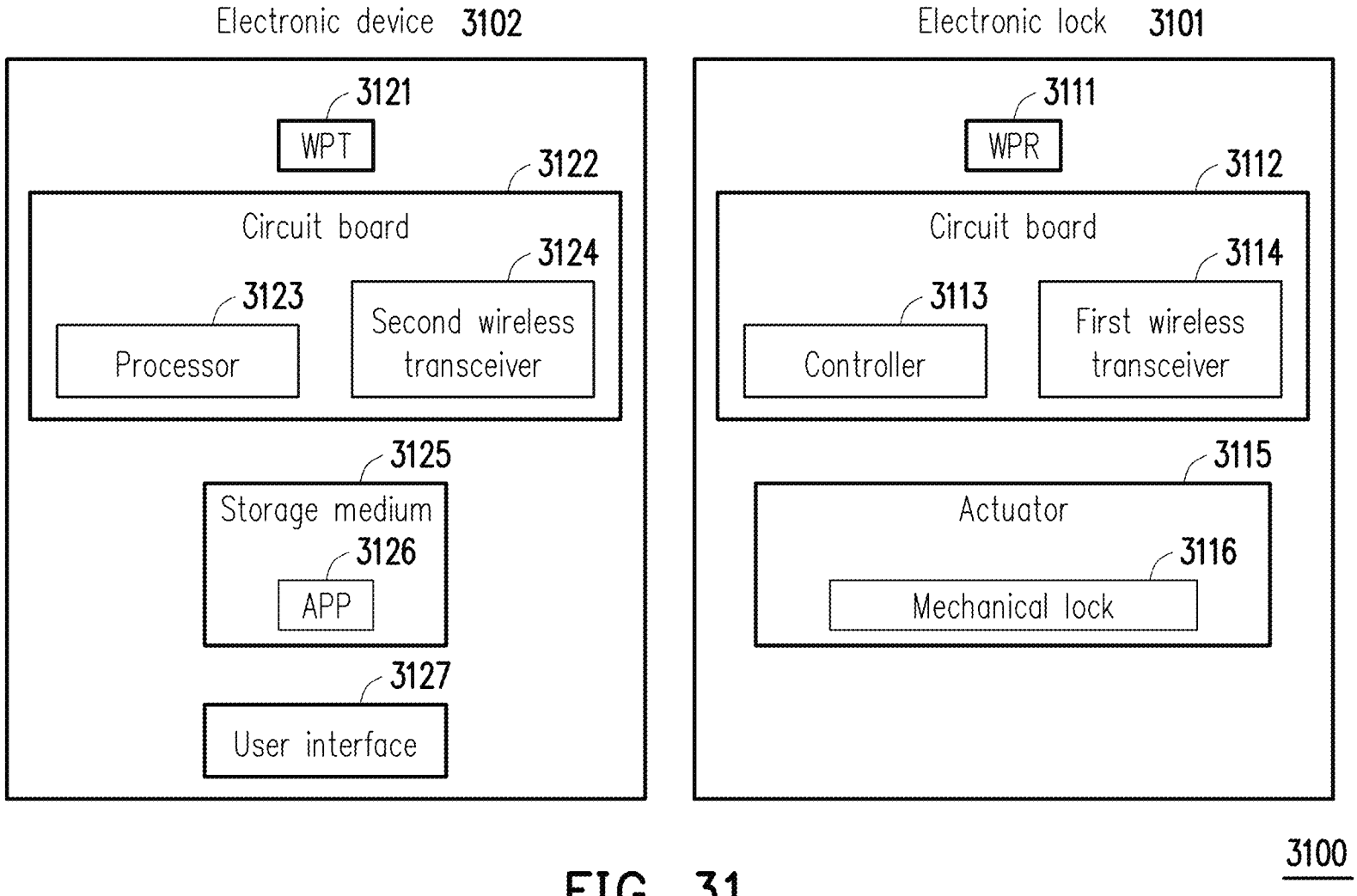
FIG. 31 is hardware block diagram which illustrates an electronic device and an electronic lock system according to another exemplary embodiment of the disclosure.

FIG. 31 is hardware block diagram which illustrates an electronic device and an electronic lock system according to another exemplary embodiment of the disclosure. The electronic lock system 3100 includes (but not limited to) an electronic lock 3101 and an electronic device 3102. The electronic lock 3101 includes a WPR 3111 which receives wireless electrical power to provide power for the electronic lock 3101, a circuit board 3112, and an actuator 3115. The circuit board 3112 is electrically connected to the WPR 3111 and includes a first wireless transceiver 3114 which receives a lock command or an unlock command transmitted wirelessly from the electronic device 3102 and a controller 3113 which is configured to generate a lock signal or an unlock signal in response to receiving the lock command or the unlock command. The actuator 3115 is electrically connected to the circuit board 3112 and receives the lock control signal to lock the mechanical lock component 3116 or receives the unlock control signal to unlock the mechanical lock component 3116.

The electronic device 3102 includes (but not limited to) a power source, a WPT 3121, and a circuit board 3122. The WPT 3121 is connected to the power source and configured to provide wireless electrical power. The circuit board 3122 includes a processor 3123 and a second wireless transceiver 3124. The processor 3123 is configured to enable the WPT 3121 to transmit wireless electrical power to the WPR 3111 of the electronic lock 3101 and to transmit the lock command or the unlock command through the second wireless transceiver 3124 to lock or unlock the electronic lock 3101.

The electronic device 3102 further includes a non-transitory storage medium 3125 and a user interface 3127. The non-transitory storage medium 3125 could be a non-volatile memory such as a flash drive, a hard disk drive (HDD), and etc. The user interface could be a hard keyboard, a touch screen, buttons, and etc. The storage medium 3125 stores programming codes of an APP 3126 which is to be loaded into the processor 3123 to implement functions associated with controlling the electronic lock 3101. Through the APP 3126, a user may input a lock command or unlock command into the user interface 3127. Assuming that the WPR 3111 has received sufficient power, as the electronic device 3102 approaches the electronic lock 3101, the user may lock or unlock the mechanical lock 3116 by inputting commands through the user interface 3127. The lock or unlock command could be transmitted from the second wireless transceiver 3124 to the first wireless transceiver 3114 or could be transmitted as a modulated data transmitted from the WPT 3121 to the WPR 3111.

Figure 32:
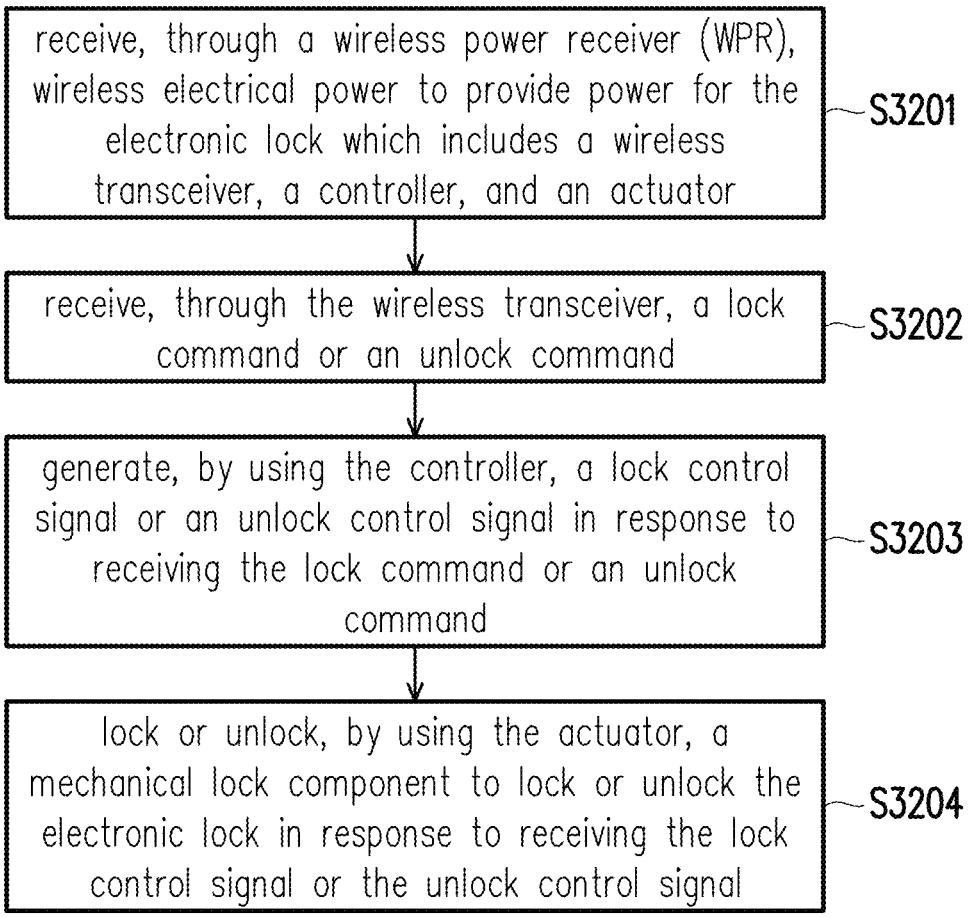
FIG. 32 illustrates a method of operating an electronic lock according to another exemplary embodiment of the disclosure.

FIG. 32 illustrates a method of operating an electronic lock according to an exemplary embodiment of the disclosure. In step S3201, the electronic lock receives, through a wireless power receiver (WPR), wireless electrical power to provide power for the electronic lock which includes a wireless transceiver, a controller, and an actuator. In order to receive sufficient power to operate the electronic lock, the WPR may apply some wireless power transfer technologies such as inductive coupling, resonant, inductive coupling, or capacitive coupling, which can be used in the wireless charging systems for smart phones, tablet personal computer, laptop personal computer, or electric vehicles. In step S3202, the electronic lock receives, through the wireless transceiver, a lock command or an unlock command. In step S3203, the electronic lock generates, by using the controller, a lock control signal or an unlock control signal in response to receiving the lock command or an unlock command. In step S3204, the electronic lock locks or unlocks, by using the actuator, a mechanical lock component to lock or unlock the electronic lock in response to receiving the lock control signal or the unlock control signal.

In view of the aforementioned descriptions, the disclosure is suitable for being used by an electronic lock or an electronic device having the electronic lock to avoid the inconvenience of having to require a battery or to charge a battery so as to realize a true battery-less design of a smart lock or an electronic device. Moreover, the electronic lock and the electronic device of the disclosure do not require any power cord so as to eliminate the inconvenience of having to carry a power cord.

No element, act, or instruction used in the detailed description of disclosed embodiments of the present application should be construed as absolutely critical or essential to the present disclosure unless explicitly described as such. Also, as used herein, each of the indefinite articles "a" and "an" could include more than one item. If only one item is intended, the terms "a single" or similar languages would be used. Furthermore, the terms "any of" followed by a listing of a plurality of items and/or a plurality of categories of items, as used herein, are intended to include "any of", "any combination of", "any multiple of", and/or "any combination of multiples of the items and/or the categories of items, individually or in conjunction with other items and/or other categories of items. Further, as used herein, the term "set" is intended to include any number of items, including zero. Further, as used herein, the term "number" is intended to include any number, including zero.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electronic lock without an active power source, the electronic lock comprising:

a wireless power receiver (WPR) which receives wireless electrical power to solely provide power for the electronic lock with the received wireless electrical power;

a circuit board electrically connected to the WPR and comprising:

a wireless transceiver which receives a lock command or an unlock command; and a controller configured to generate a lock control signal or an unlock control signal in response to receiving the lock command or the unlock command; and an actuator electrically connected to the circuit board and receives the lock control signal to lock a mechanical lock component or the unlock control signal to unlock the mechanical lock component, wherein the electronic lock does not include a battery and does not externally connect to a battery or a power supply other than the received wireless electrical power, such that the electronic lock is solely powered by the wireless power receiver via wireless electric power.

2. The electronic lock of claim 1, wherein the WPR is an external module which is external to the electronic lock and is plugged in or connected to the electronic lock through a connector.

3. The electronic lock of claim 1, wherein the WPR is is within a same package as the electronic lock.

4. The electronic lock of claim 1, wherein the WPR further comprising a communication module to receive modulated data which was modulated onto the wireless electrical power.

5. The electronic lock of claim 4, wherein the controller is further configured to receive the lock command or the unlock command by demodulating from the modulated data.

6. The electronic lock of claim 1, wherein in response to the WPR storing sufficient power, the WPR powers up the circuit board to wait for the lock command or the unlock command.

7. An electronic lock system comprising:

an electronic lock without an active power source;

a wireless power transmitter (WPT) which transmits wireless electrical power; and an electronic device for remotely controlling the electronic lock, wherein the electronic lock comprising:

a wireless power receiver (WPR) which receives the wireless electrical power from the WPT to solely provide power for the electronic lock with the received wireless electrical power;

a circuit board electrically connected to the WPR and comprising:

a first wireless transceiver which receives a lock command or an unlock command; and a controller configured to generate a lock control signal or an unlock control signal in response to receiving the lock command or the unlock command; and an actuator electrically connected to the circuit board and receives the lock control signal to lock a mechanical lock component or the unlock control signal to unlock the mechanical lock component, wherein the electronic lock does not include a battery and does not externally connect to a battery or a power supply other than the received wireless electrical power, such that the electronic lock is solely powered by the wireless power receiver via wireless electric power.

8. The electronic lock system of claim 7, wherein the electronic device comprising:

a power source; and a circuit board powered by the power source and comprising:

a processor; and a second wireless transceiver coupled to the processor, wherein the processor is configured to:

transmit the lock command or the unlock command through the second wireless transceiver to lock or unlock the electronic lock.

9. The electronic lock system of claim 8, wherein the WPT is an external module which is external to the electronic lock and is plugged in or connected to the power source through a connector.

10. The electronic lock system of claim 8, wherein the WPT within a same package as the electronic device.

11. The electronic lock system of claim 9, wherein the processor is further configured to enable the WPT to transmit the wireless electrical power to the WPR of the electronic lock.

12. The electronic lock system of claim 7, wherein the processor is further configured to detect whether the WPR has received the wireless electrical power to be within a specific power range and power the electronic lock only when the received wireless electrical power is within the specific power range.

13. The electronic lock system of claim 8, wherein the lock command or the unlock command is initially generated from an application (APP) installed in the electronic device.

14. The electronic lock system of claim 7, wherein the WPT is an external module which is plugged in or connected to another power source.

15. The electronic lock system of claim 7, wherein the WPT is internally built and is within the same package as another power source.

16. The electronic lock system of claim 7, wherein the WPT further comprising a communication module to transmit modulated data which is modulated onto the wireless electrical power.

17. The electronic lock system of claim 7, wherein the WPR is an external module which is external to the electronic lock and is plugged in or connected to the electronic lock.

18. The electronic lock system of claim 7, wherein the WPR is within a same package as the electronic lock.

19. The electronic lock system of claim 7, wherein the WPR further comprising a communication module to receive modulated data which was modulated onto the wireless electrical power.

20. The electronic lock system of claim 19, wherein the controller is further configured to receive the lock command or the unlock command by demodulating from the modulated data.

21. The electronic lock system of claim 7, wherein in response to the WPR storing sufficient power, the WPR powers up the circuit board to wait for the lock command or the unlock command.

* * * * *